United States Patent [19]

Goodrich

[11] Patent Number: 4,584,023

[45] Date of Patent: Apr. 22, 1986

[54] METHOD FOR PRODUCING INDUSTRIAL ASPHALTS WITHOUT AIR-BLOWING USING PHYTIC ACID

[75] Inventor: Judson E. Goodrich, San Rafael, Calif.

[73] Assignee: Chevron Research Company, San Francisco, Calif.

[21] Appl. No.: 672,426

[22] Filed: Oct. 31, 1984

[51] Int. Cl.[4] ..... C08L 95/00

[52] U.S. Cl. ..... 106/273 R; 208/44

[58] Field of Search ..... 106/273 R; 208/40, 44

[56] References Cited

U.S. PATENT DOCUMENTS 3,751,278 8/1973 Alexander ..... 106/273

4,440,579 4/1984 Eidem ..... 106/274

*Primary Examiner*—Amelia B. Yarbrough

*Attorney, Agent, or Firm*—S. R. LaPaglia; R. C. Gaffney; J. J. DeYoung

[57] ABSTRACT

Disclosed is a one-step method of producing an industrial asphalt from a bituminous material which comprises mixing together without air-blowing:

(a) a feed material comprising a bituminous material having a viscosity of at least 50 centistokes at 350 degrees Fahrenheit and wherein the feed petroleum residuum forms a single phase when mixed with 5 weight percent phytic acid; and (b) from about 0.1 to 20.0 percent by weight of phytic acid, said mixing being done at a temperature in the range of 351 to 600 degrees Fahrenheit, whereby the softening point of the feed is substantially increased and the penetration is significantly decreased.

11 Claims, 1 Drawing Figure

SOFTENING POINT AND PENETRATION RANGES OF INDUSTRIAL ASPHALT GRADES

SOFTENING POINT AND PENETRATION RANGES OF INDUSTRIAL ASPHALT GRADES

METHOD FOR PRODUCING INDUSTRIAL ASPHALTS WITHOUT AIR-BLOWING USING PHYTIC ACID

BACKGROUND OF THE INVENTION

The present invention relates to a method for modifying the physical properties of bituminous materials and to asphalt compositions obtained therefrom. More particularly, the present invention relates to a method of producing industrial asphalts without air-blowing. Industrial asphalts have many uses but are particularly useful in roofing applications.

The physical properties of various types of asphalt vary over a wide range. Paving asphalts, industrial asphalts and cutback asphalts, etc., have tremendously different properties as measured by viscosity, penetration, softening point, etc. The differences between various types of asphalts are well known in the art. See, for example, Encyclopedia of Chemical Technology, Third Edition, Volume 3, pages 284–326.

FIG. 1 is a softening point-penetration plot for various industrial asphalt grades. The four rectangles in FIG. 1 outline the properties of Types I–IV industrial asphalts as defined by the American Society for Testing and Materials (ASTM-D312). The plot illustrates the tremendously varying properties required of industrial asphalts for different applications. Industrial asphalts have softening points above 135 degrees Fahrenheit.

Properties of bituminous materials may be modified by such well-known treating means as solvent extraction, air-blowing and the like.

Air-blowing processes using catalysts are known in the art for making industrial asphalts. However, air-blowing processes require complex and expensive air-blowing equipment which must meet ever more stringent air pollution regulations. Furthermore, air-blowing requires long processing times on the order of hours.

U.S. Pat. No. 3,751,278 discloses a process for treating asphalts without air-blowing using phosphoric acids having an $H_3PO_4$ equivalent of greater than 100 percent. The compositions produced by this process are directed to paving asphalts particularly useful in highway construction and maintenance. Paving asphalts usually have softening points below 135 degrees Fahrenheit and penetrations from 20 to 300 dmm at 77 degrees Fahrenheit. This patented process is particularly directed to treating asphalts to substantially increase the viscosity without a significant decrease in penetration.

U.S. Pat. No. 3,120,486 discloses a process for refining and deodorizing a petroleum fraction using a low molecular-weight organic acid, acid anhydride, acid chloride, etc., with polyphosphoric acid.

U.S. Pat. No. 2,179,208 teaches a process for making asphalt which comprises air-blowing in the absence of any catalyst at a temperature of 300 to 500 degrees Fahrenheit for 1 to 30 hours followed by a second step of heating that material to a temperature greater than 300 degrees Fahrenheit with a small amount of polymerizing catalysts. The catalysts include sulfuric acid, ferric chloride, $BF_3$, etc. Using small amounts of these catalysts, products with melting points of 140 degrees Fahrenheit or less were produced. The patent teaches that overall processing times are significantly reduced using this two-step process.

U.S. Pat. No. 4,440,579 teaches that phytic acid has been used as an asphalt air-blowing catalyst.

NBS (National Bureau of Standards) Report 8607, dated Dec. 16, 1964, Air-Blowing of Asphalts in the Presence of Additive Oils, Catalysts, and Polymers, discloses phytic acid as an asphalt air-blowing catalyst.

One object of the present invention is to produce an industrial asphalt in a simple one-step process without any prior air-blowing treatment of the bituminous material feed stock or any post air-blowing treatment of the asphalt formed.

A second object of the present invention is to provide a process for producing industrial asphalts where treatment times are very short, in the order of 5 to 25 minutes or less.

Another object of the present invention is to provide a process which can utilize as a feed, bituminous materials which heretofore could not be used in making industrial asphalts by the prior art air-blowing process without the addition of substantial amounts of lower boiling hydrocarbons.

SUMMARY OF THE INVENTION

The present invention involves a one-step method of producing an industrial asphalt from a bituminous material which comprises mixing together without air-blowing:

(a) a feed material comprising a bituminous material having a viscosity of at least 50 centistokes at 350 degrees Fahrenheit and wherein the feed material forms a single phase when mixed with 5 weight percent of phytic acid; and (b) from about 0.1 to 20.0 percent by weight of phytic acid, said mixing being done at a temperature in the range of 351 to 600 degrees Fahrenheit, whereby the softening point of the feed is substantially increased and the penetration is significantly decreased.

DETAILED DESCRIPTION OF THE INVENTION

Figure 1:
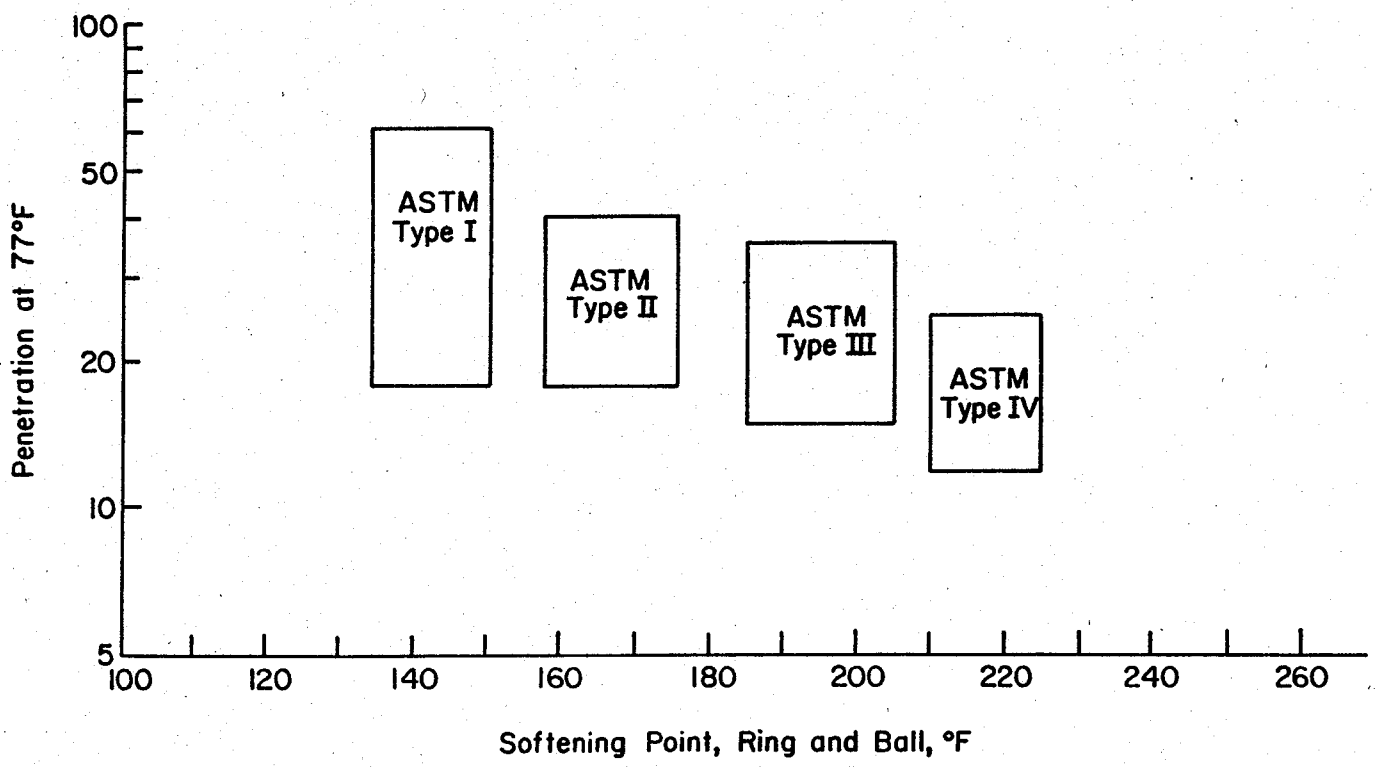

The industrial asphalts of the present invention are prepared by starting with particular bituminous materials and mixing them without air-blowing with phytic acid to produce industrial asphalt. The product industrial asphalts of the present invention are formed in a one-step process without any air-blowing or other oxidation treatment of the starting material prior to or after treatment with phytic acid.

Feeds suitable for use in the present invention called bituminous materials ("Bituminous Materials: Asphalts, Tars, and Pitches" Vol. I, A. J. Hoiberg, Editor, 1964, Interscience, pages 2–5, the disclosure of which is incorporated herein by reference) can be of varied character. Many petroleum residua (also known as fluxes) remaining following the separation of vaporizable hydrocarbons from oil fractions or any relatively high molecular weight extract obtained from petroleum refining or from naturally occurring hydrocarbons, including tar and Gilsonite, can be used.

It is critical for the one-step process of the present invention that the bituminous material feed stock have the following two characteristics:

(1) A viscosity of at least 50 centistokes when measured at 350 degrees Fahrenheit; and (2) Forms a single phase when mixed with 5 weight percent phytic acid. It has been surprisingly found that feed stocks not meeting this critical parameter will not form industrial asphalts utilizing the simple one-step process of the present invention.

Generally the feed will have an initial viscosity at 350 degrees Fahrenheit of at least 50 cSt. In the process of the present invention, the softening point is substantially increased and the penetration point is significantly decreased thereby producing industrial asphalts. Generally, the feed flux will have a softening point in the range of 100 to 200 degrees Fahrenheit, preferably 110 to 150 degrees Fahrenheit and a penetration in the range 30 to 150, preferably 40 to 100 dmm at 77 degrees Fahrenheit. Generally, the viscosity of the feed is 50 to 200 cSt and more preferably 65 to 180 cSt. Particularly preferred feed materials include: petroleum distillation residue, a blend of hard petroleum distillation residue, a blend of Gilsonite, a blend of pitch from a solvent deasphalting process, a blend of pitch from a supercritical solvent deasphalting process. Any of the above blends can contain petroleum distillate or vegetable oil diluents.

One surprising feature of the present invention resides in the finding that by the critical selection of the bituminous material feed, one can produce industrial asphalts in a simple one-step process without prior or post-treatments involving air-blowing, characteristic of prior art processes.

The bituminous material feed stock is mixed with 0.1 to 20.0 percent by weight, preferably 0.2 to 12.0 percent and more preferably more than 0.5 and less than 10.0 percent by weight of phytic acid. The quantity of phytic acid to be utilized in the present invention is inversely proportional to the viscosity of the feed material. Thus, feed stocks having low viscosities, e.g., about 60 cSt. at 350 degrees Fahrenheit, require larger amounts of acid, e.g., about 8%. On the other hand, feed stocks having high viscosities, e.g., about 200 cSt. at 350 degrees Fahrenheit, need relatively lower amounts of acid, e.g., about 0.5 to 2%. Phytic acid (inositol hexaphosphoric acid) is readily available commercially at 40 percent concentration.

The treating method of the present invention comprises heating the feed stock to a temperature in the range 351 to 600 degrees Fahrenheit, preferably 400 to 500 degrees Fahrenheit to facilitate mixing and reacting with the phytic acid.

After the starting material has been heated to a temperature sufficient for mixing purposes, at least above its softening point, the phytic acid is most often introduced into the hot feed with continuous agitation. Agitation is usually supplied by mechanical means and must be adequate to disperse the phytic acid intimately throughout the asphalt. A preferred alternative process for mixing involves the use of in-line blending and a static mixer which further facilitates very short mixing and reaction time.

The present method of treating bituminous materials does not include air-blowing of the feed stock during mixing or as a part of the treatment, the treatment being carried out without passing air through the material either before, during or after treatment as is done in conventional prior art processes.

The entire one-step acid treatment process of the present invention requires from 1 to 30 minutes or more. Longer process times can also be utilized but are not necessary and are less economical. Preferably, the acid treatment time ranges from 5 to 25 minutes. Not included in the treatment time is the time required to initially heat the petroleum residua to treatment temperature.

In the process of the present invention the softening point of the feed asphalt is substantially increased and the penetration is significantly decreased. The amount of increase in the softening point and decrease in penetration will vary greatly depending upon the properties of the feed and the amount of catalyst used and the mixing temperature. Generally, the higher the amount of catalyst used the greater will be the increase in softening point and the greater the decrease in penetration. Also, starting with harder feedstocks, one will generally obtain a smaller change in the softening point and penetration of the product industrial asphalt than starting with softer feedstocks. Generally, it is desired to substantially increase the softening point by 10 to 120 degrees Fahrenheit, wherein harder feedstocks have values at the lower end of the range and softer feedstocks have values at the upper end of the range. Generally, it is desired to significantly lower the penetration at 77 degrees Fahrenheit by from about 5 to 80 dmm, wherein harder feedstocks have values at the lower end of the range and softer feedstocks have values at the upper end of the range. Starting with softer feedstocks, the preferred range for the increase in softening point is 30 to 70 degrees Fahrenheit and the penetration decreases in the range of 10 to 60 dmm.

The product industrial asphalts of the present invention will preferably have a softening point of 130 to 240 degrees Fahrenheit, and more preferably 200 to 235 degrees Fahrenheit with a penetration at 77 degrees Fahrenheit from 10 to 70 dmm, preferably 12 to 30 dmm.

To further describe and to exemplify the present invention, the following examples are presented. These examples are in no manner to be construed as limiting the present invention. In the following examples the viscosity was determined using ASTM D2170, the penetration by ASTM D5, and softening point by ASTM D2398. Each feed stock was tested for compatibility with phythic acid by mixing 100 grams of asphalt with 5 grams of 40 percent phytic acid at 450 degrees Fahrenheit for 15 minutes and then visually checking whether it separated into two phases. If it separated into two phases, it fails the test and will not form an industrial asphalt using the one-step process of the present invention.

EXAMPLES

EXAMPLE 1

A 200 g sample of a 50/50 blend of Gilsonite and a lubricating oil distillate having a penetration at 77 degrees Fahrenheit of 43 dmm, a viscosity at 350 degrees Fahrenheit of 136 cSt, and a ring and ball softening point of 162 degrees Fahrenheit, was heated to 325 degrees Fahrenheit with slow stirring and nitrogen injection. To the asphalt was slowly added 2.4 g of 40 percent phytic acid. Stirring speed was increased to about 850 rpm and the temperature was raised to 450 degrees Fahrenheit. Stirring with nitrogen injection was continued for 20 minutes. The properties of the product are given in Table I along with the properties of other asphalt feeds and products as compared with uncatalyzed product.

TABLE I

| Example No. | Feed Type (1) | Phytic Acid Wt. % | Product Properties Pen (2) dmm | Softening Pt. (3) degrees Fahrenheit |
|---|---|---|---|---|
| 1 | Gilsonite | 0.5 | 39 | 208 |
| 2 | Montalvo | 0 | 83 | 121 |
| 3 | Montalvo | 0.5 | 62 | 132 |
| 4 | Montalvo | 1.0 | 45 | 148 |
| 5 | Montalvo | 2.3 | 33 | 184 |
| 6 | Montalvo | 5.0 | 22 | 225 |
| 7 | Montalvo | 10.0 | 17 | 249 |

(1) Feed stock description:
(a) Gilsonite = 50/50 Gilsonite/Lubricating Oil Distillate. The product had a viscosity of 746 cSt at 350 degrees Fahrenheit.
(b) Montalvo is a paving asphalt obtained from the distillation residue of Montalvo crude.
(2) Penetration in decimillimeters (dmm) measured at 77 degrees Fahrenheit.
(3) Softening point, using ring and ball method

What is claimed is:

1. A one-step method of producing an industrial asphalt from a bituminous material which comprises mixing together without air-blowing:

(a) a feed material comprising a bituminous material having a viscosity of at least 50 centistokes at 350 degrees Fahrenheit and wherein the feed material forms a single phase when mixed with 5 weight percent phytic acid; and (b) from about 0.1 to 20.0 percent by weight of phytic acid, said mixing being done at a temperature in the range of 351 to 600 degrees Fahrenheit, whereby the softening point of the feed is substantially increased and the penetration is significantly decreased.

2. The method of claim 1 wherein the softening point of the feed is increased by 10 to 120 degrees Fahrenheit and the penetration is decreased by 5 to 80 dmm.

3. The method of claim 2 wherein the softening point of the feed is increased by 30 to 70 degrees Fahrenheit and the penetration is decreased by 10 to 60 dmm.

4. The method of claim 3 wherein said mixing is carried out in 5 to 25 minutes.

5. The method of claim 4 wherein the amount of phytic acid is in the range of 0.2 to 12 percent by weight.

6. The method of claim 5 wherein the industrial asphalt has a softening point in the range 130 to 240 degrees Fahrenheit and a penetration in the range 10 to 70 dmm at 77 degrees Fahrenheit.

7. The method of claim 5 wherein the industrial asphalt has a softening point in the range 200 to 235 degrees Fahrenheit and a penetration in the range 12 to 30 dmm at 77 degrees Fahrenheit.

8. A one-step method of producing an industrial asphalt from a petroleum residuum which comprises mixing together without air-blowing:

(a) a feed comprising a petroleum residuum having a viscosity of 65 to 180 centistokes at 350 degrees Fahrenheit and wherein said feed forms a single phase when mixed with 5 weight percent phytic acid; and (b) from more than 0.5 to less than 10 percent by weight of phytic acid, said mixing being done at a temperature in the range of 400 to 500 degrees Fahrenheit for from 5 to 25 minutes; whereby the softening point of the petroleum residuum is substantially increased by 30 to 70 degrees Fahrenheit and the penetration is significantly decreased by at least 10 to 60 dmm at 77 degrees Fahrenheit thereby producing an industrial asphalt having a softening point in the range 200 to 235 degrees Fahrenheit and a penetration of 12 to 30 dmm.

9. An industrial grade asphalt composition produced by the method of claim 1.

10. An industrial grade asphalt composition produced by the method of claim 7.

11. An industrial grade asphalt composition produced by the method of claim 8.

* * * * *